US009312617B2

(12) United States Patent
Hirata

(10) Patent No.: US 9,312,617 B2
(45) **Date of Patent: *Apr. 12, 2016**

(54) BOARD-TO-BOARD CONNECTOR HAVING A DETECTION SWITCH

(75) Inventor: Toshihisa Hirata, Yamato (JP)

(73) Assignee: Molex, LLC, Lisle, IL (US)

( * ) Notice: Subject to any disclaimer, the term of this patent is extended or adjusted under 35 U.S.C. 154(b) by 49 days.

This patent is subject to a terminal disclaimer.

(21) Appl. No.: 13/825,073

(22) PCT Filed: Sep. 21, 2011

(86) PCT No.: PCT/US2011/052468

§ 371 (c)(1),
(2), (4) Date: May 28, 2013

(87) PCT Pub. No.: WO2012/040273

PCT Pub. Date: Mar. 29, 2012

(65) Prior Publication Data

US 2013/0330970 A1 Dec. 12, 2013

(30) Foreign Application Priority Data

Sep. 21, 2010 (JP) ..... 2010-210720

(51) Int. Cl.
*H01R 12/00* (2006.01)
*H01R 12/70* (2011.01)
(Continued)

(52) U.S. Cl.
CPC ..... *H01R 12/7094* (2013.01); *H01R 12/716* (2013.01); *H01R 13/703* (2013.01)

(58) Field of Classification Search
CPC .... H01R 13/641; H01R 31/08; H01R 12/716; H01R 12/7082; H01R 12/73; H01R 23/72; H01R 12/7005; H01R 12/52; H01R 12/57; H01R 13/20; H01R 12/721; H01R 13/24; H01R 13/514; H01R 13/6275; H01R 13/6315; H01R 43/0256; H01R 9/096
USPC ..... 439/489, 74, 188
See application file for complete search history.

(56) References Cited

U.S. PATENT DOCUMENTS 5,545,051 A * 8/1996 Summers et al. ..... 439/350
6,132,258 A * 10/2000 Kajinuma ..... 439/660
(Continued)

FOREIGN PATENT DOCUMENTS

JP 2001-257019 A 9/2001
JP 2009-259675 A 11/2009
(Continued)

OTHER PUBLICATIONS

International Search Report for PCT/US2011/052468.

*Primary Examiner* — Xuong Chung Trans
(74) *Attorney, Agent, or Firm* — Jeffrey K. Jacobs

(57) ABSTRACT

A board-to-board connector comprising a first connector having a first terminal and a first housing that includes a first fitting guide part formed on both ends in the long side direction, and a second connector having a second terminal that contacts to the first terminal and a second housing that includes a second fitting guide part that fits with the first fitting guide part, includes a switch that closes a detection circuit that electrically detects a complete fit of the first connector and the second connector. In one embodiment, each switch has the ability to mutually contact, and one side of the switch is a first reinforcing bracket, and the other side is a second reinforcing bracket.

9 Claims, 13 Drawing Sheets

(51) Int. Cl.
*H01R 12/71* (2011.01)
*H01R 13/703* (2006.01)

(56) References Cited

U.S. PATENT DOCUMENTS

| | | | | |
|---|---|---|---|---|
| 6,902,411 | B2 * | 6/2005 | Kubo | 439/74 |
| 7,128,581 | B2 | 10/2006 | Igarashi et al. | |
| 7,402,071 | B2 * | 7/2008 | Ohtaka et al. | 439/357 |
| 7,431,605 | B2 * | 10/2008 | Dieterle et al. | 439/358 |
| 7,581,985 | B2 * | 9/2009 | Sakamoto | 439/566 |
| 7,585,185 | B2 * | 9/2009 | Obikane | 439/607.01 |
| 7,914,319 | B2 * | 3/2011 | Jones et al. | 439/489 |
| 8,075,324 | B2 * | 12/2011 | Yamaji et al. | 439/188 |
| 8,083,527 | B2 * | 12/2011 | Takeuchi et al. | 439/65 |
| 8,092,232 | B2 * | 1/2012 | Takeuchi | 439/74 |
| 8,465,298 | B2 | 6/2013 | Takeuchi et al. | |
| 8,840,407 | B2 * | 9/2014 | Nose et al. | 439/74 |
| 8,888,506 | B2 * | 11/2014 | Nishimura et al. | 439/74 |
| 2006/0183378 | A1 | 8/2006 | Tanaka et al. | |
| 2008/0287004 | A1 | 11/2008 | Miyamoto et al. | |
| 2009/0286416 | A1 | 11/2009 | Wu | |
| 2013/0210270 | A1 * | 8/2013 | Takeuchi et al. | 439/488 |

FOREIGN PATENT DOCUMENTS

| | | | |
|---|---|---|---|
| JP | 2011-243332 | A | 12/2011 |
| WO | WO 2008/150523 | A2 | 12/2008 |
| WO | WO 2009/061507 | A2 | 5/2009 |

* cited by examiner

BOARD-TO-BOARD CONNECTOR HAVING A DETECTION SWITCH

REFERENCE TO RELATED APPLICATIONS

The Present Disclosure claims priority to prior-filed Japanese Patent Application No. 2010-210720, entitled "Board-To-Board Connector," filed on 21 Sep. 2010 with the Japanese Patent Office. The contents of the aforementioned patent application is fully incorporated in its entirety herein.

BACKGROUND OF THE PRESENT DISCLOSURE

The Present Disclosure relates, generally, to a board-to-board connector.

Board-to-board connectors have been used conventionally to electrically connect a mutual pair of parallel circuit boards. This type of board-to-board connector is configured for conductivity by mutually fitting a pair of circuit boards by each attaching mutually facing surfaces. Further, technology has been proposed that holds the fitted state with the other connector with a reinforcing bracket attached to both end parts functioning as a locking member. An example is disclosed in Japanese Patent Application No. 2004-055306.

FIG. 13 is a perspective view illustrating the pre-fit state of a conventional board-to-board connector. Referring to FIG. 13, reference 801 in the drawing is the first connector which is one side of a pair of board-to-board connectors, and is mounted on the surface of the first board 891. Further, reference 901 in the drawing is the second connector which is the other side of a pair of board-to-board connectors, and is mounted on the surface of the second board 991. The first connector 801 includes a first housing 811, and a plurality of first terminals 861 mounted on the first housing 811, and the second connector 901 includes a second housing 911 and a plurality of second terminals 961 mounted on the second housing 911. In addition, when the first connector 801 and the second connector 901 are fit together, the first board 891 and the second board 991 are electrically connected by the mutual contact between the corresponding first terminals 861 with the second terminals 961.

A recessed part 812 is formed on the first housing 811 to receive the second housing 911 while an engaging raised part 813 is formed within the recessed part 812. Meanwhile, an engaging recessed part 913 is formed on the second housing 911 to receive the engaging raised part 813.

In addition, a first metal fitting 851 is attached to both ends in the long side direction of the first housing 811. The first metal fitting 851 is provided with a first tail part 852 that is soldered to the surface of the first board 891, and is also provided with a first locking projection 853 that protrudes. Additionally, a second metal fitting 951 is attached to both ends in the long side direction of the second housing 911. The second metal fitting 951 is provided with a second tail part 952 that is soldered to the surface of the second board 991, and is also provided with a second locking projection 953 that protrudes.

Further, when the first connector 801 and the second connector 901 are fit together, the engaging raised part 813 and the engaging recessed part 913 are mutually engaged while the first locking projection 853 of the first metal fitting 851 and the second locking projection 953 of the second metal fitting 951 are mutually engaged. By so doing the first connector 801 and the second connector 901 are locked together and are held by a fitted state.

Moreover, at the time of fitting, either one of the first connector 801 or the second connector 901 is vertically inverted from the disposition illustrated in the drawing so as to fit with the other connector.

SUMMARY OF THE PRESENT DISCLOSURE

However, with the conventional board-to-board connector, it is difficult to confirm whether the first connector 801 and the second connector 901 are completely fit. That is to say that because either one of the first connector 801 or the second connector 901 is vertically inversed at the time of fitting and the second housing 911 is received into the recessed part 812 of the first housing 811, visual confirmation from the outside cannot be made to confirm whether the first locking projection 853 of the first metal fitting 851 positioned on the inner side of the recessed part 812 is engaged with the second locking projection 953 of the second metal fitting 951 that is attached to the second housing 911.

Reasonably, if there is a large degree of projection by the second housing 911 from the top end of the first housing 811, a determination can be made visually whether the fit of the first connector 801 and the second connector 901 is incomplete. However, because the first board 891 and the second board 991 which have significantly larger surface areas than the bottom surfaces of the first housing 811 and the second housing 911, are attached to the bottom surface of the first housing 811 and the second housing 911, visual confirmation of the degree of projection by the second housing 911 from the top end of the first housing 811 is difficult.

Particularly, due to advancements in smaller and low height board-to-board connectors in recent years, making an accurate visual confirmation of the degree of projection by the second housing 911 from the top end of the first housing 811, and making an accurate determination whether the first connector 801 and the second connector 901 are completely fixed has become extremely difficult.

An object of the Present Disclosure, in solving the problem of the conventional board-to-board connector, is to provide a board-to-board connector that can accurately detect a complete fit with high reliability for the first connector and the second connector even in a fitting process of a small size and low height board-to-board connector by electrically detecting the complete fit of the first connector and second connector, and can securely prevent the occurrence of incomplete fitting in a fitting process.

Therefore, the board-to-board connector of the Present Disclosure is composed of a first connector that provides a first terminal and a first housing that includes a first fitting guide part formed on both ends in the long side direction, and a second connector that provides a second terminal that contacts the first terminal and a second housing that includes a second fitting guide part that fits with the first fitting guide part, wherein the board-to-board connector includes a switch that closes a detection circuit that electrically detects a complete fit of the first connector and the second connector.

Another board-to-board connector of the Present Disclosure is further composed wherein the first connector has a first reinforcing bracket provided on the first fitting guide part, the second connector has a second reinforcing bracket provided on the second fitting guide part, and the switch includes a plurality of switching members with the ability to mutually contact and one side of the switching member is the first reinforcing bracket and the other side is the second reinforcing bracket.

Still another board-to-board connector of the Present Disclosure is further composed wherein the first reinforcing bracket includes a flexible contact segment and the second reinforcing bracket includes a rigid contact segment, and the flexible contact segment flexibly displaces while maintaining contact with the rigid contact segment when the first connector and the second connector relatively move further in the fit direction from a position of a complete fit.

Still another board-to-board connector of the Present Disclosure is further composed wherein the first housing includes a stopper, and the displacement by the flexible contact segment in the fit surface direction of the first housing is regulated by the stopper.

Still another board-to-board connector of the Present Disclosure is further composed wherein the first reinforcing bracket and the second reinforcing bracket are electrically connected to an anchoring pad on the board, and a detecting pad is formed on the board, and the detecting pad is on both ends of the detection circuit.

According to the Present Disclosure, the board-to-board connector electrically detects the complete fit of the first connector and second connector. In doing so, a complete fit of the first connector and second connector can be accurately detected even in a fitting process of a small size and low height board-to-board connector, and the generation of defective fitting can be securely prevented in the fitting process thereby increasing reliability.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which.

DESCRIPTION OF THE PREFERRED EMBODIMENTS

Figure 1:
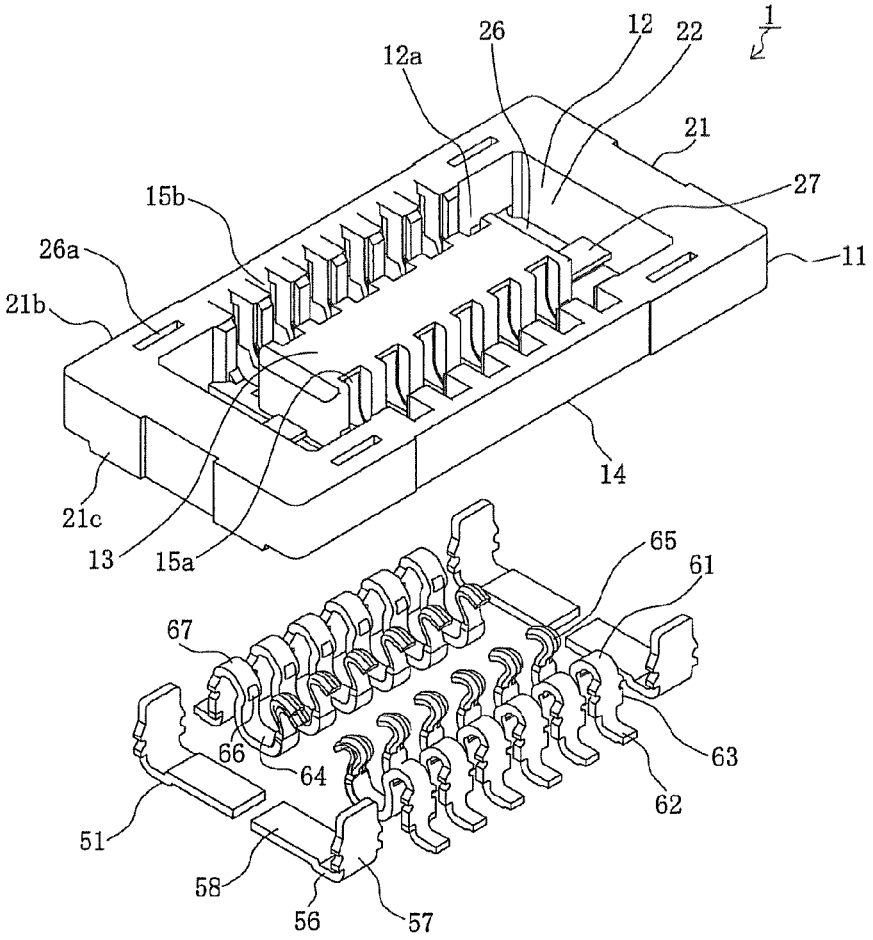
FIG. 1 is an exploded view as seen from the fitting surface side of a first connector according to the first embodiment of the Present Disclosure.
Figure 2:
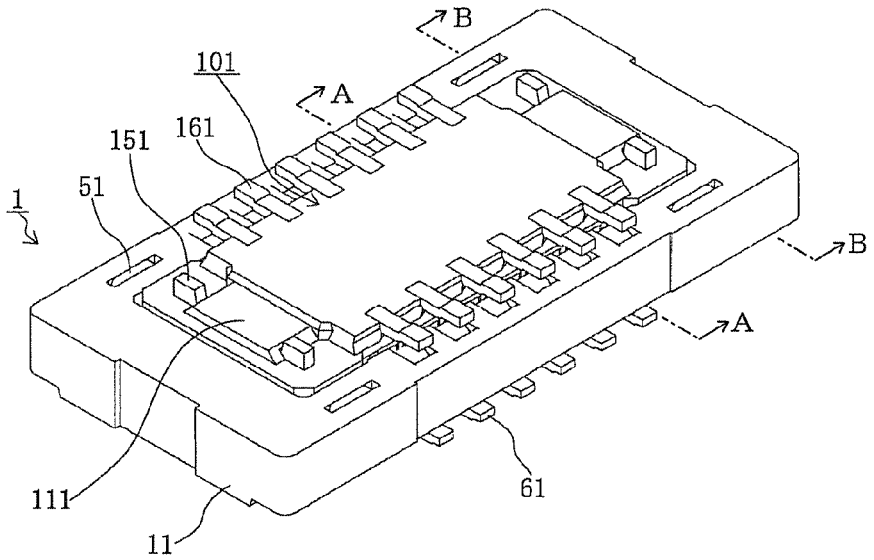
FIG. 2 is a perspective view illustrating the state in which the first connector and the second connector are mutually fitted, and is a view as seen from the fitting surface side of the first connector according to the first embodiment of the Present Disclosure.

While the Present Disclosure may be susceptible to embodiment in different forms, there is shown in the Figures, and will be described herein in detail, specific embodiments, with the understanding that the disclosure is to be considered an exemplification of the principles of the Present Disclosure, and is not intended to limit the Present Disclosure to that as illustrated.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

In the drawings, 1 is the first connector as one side of a pair of board-to-board connectors according to the present embodiment, and is a surface mount type connector mounted on the surface of the first board 91 to be described hereinafter. Furthermore, 101 is the second connector as the other side of a pair of board-to-board connectors according to the present embodiment, and is a surface mount type connector mounted on the surface of the second board 191 to be described hereinafter. The board-to-board connector according to the present embodiment includes the first connector 1 and a second connector 101, and electrically connects the first board 91 and the second board 191. Moreover, the first board 91 and the second board 191 can be any type of board including, for example, a printed circuit board used in electronic devices or the like, such as, a flexible flat cable (FFC), a flexible printed circuit (FPC), or the like.

Further, the first connector 1 includes a first housing 11 as a connector main body that is integrally formed by an insulating material such as a synthetic resin or the like. The first housing 11, as illustrated in the drawing, is provided with a substantially rectangular thick board shape that is substantially a rectangular solid, and a recessed part 12 having a substantially rectangular shape is formed around the periphery on the side where the second connector 101 engages, in other words, on the fitting surface side (top side in FIG. 1). The connector 1 is provided with dimensions such as approximately 10.0 mm long, approximately 2.5 mm wide, and approximately 1.0 mm thick, and these dimensions can be suitably changed. Further, a first ridged part 13 is integrally formed with the first housing 11 as an island part within the recessed part 12, and a side wall part 14 is integrally formed with the first housing 11 to extend in parallel with the first ridge part 13 on both sides of the first ridged part 13. In this case, the first raged part 13 and the side wall part 14 protrude upward from the bottom surface of the recessed part 12 and extend lengthwise along the first housing 11. By so doing, specifically, a recessed groove part 12*a*, that is a long thin recessed part, is formed between the first ridged part 13 and the side wall part 14 so as to extend in the lengthwise direction of the first housing 11 as a part of the recessed part 12 on both sides of the first ridged part 13. Moreover, although there is only one first ridged part 13 in the example illustrated in the drawing, there can also be a plurality and there can be any number thereof. In addition, the first ridged part 13 is provided with a dimension of, for example, 0.6 mm in width, and this dimension can be suitably changed.

Here, a first terminal receptacle inner side cavity 15*a* is formed in a recessed groove shape to the side surface of both sides of the first ridged part 13. Further, a first terminal receptacle outer side cavity 15*b* is formed in a recessed groove shape to the side surface of the inner side of the side wall part 14. Additionally, because the first terminal receptacle inner side cavity 15*a* and the first terminal receptacle outer side cavity 15*b* are mutually integrated and joined at the bottom part of the recessed groove part 12*a*, the description of the first terminal receptacle inner side cavity 15*a* and the first terminal receptacle outer side cavity 15*b* will be referred to integrally as the first terminal receptacle cavity 15.

The first terminal receptacle cavity 15 is formed in, for example, six pieces each at a pitch of approximately 0.4 mm to both sides of the first ridged part 13. Further, the first terminal 61 received into each of the first terminal receptacle cavities 15 is also arranged in, for example, six pieces each at a pitch of approximately 0.4 mm to both sides of the first ridged part 13. Note, the pitch and number of first terminal receptacle cavities 15 can be suitably changed.

The first terminal 61 is a member integrally formed by a working process such as stamping or bending a conductive metal plate, and is provided with a retention receiving part 63, a tail part 62 that is connected to the lower end of the retention receiving part 63, and upper side connecting part 67 that is connected to the upper end of the retention receiving part 63, a second contacting part 66 as a second contacting raised part that is formed in the vicinity of the inner end of the upper side connecting part 67, a lower side connecting part 64 that is connected to the second contacting part 66, and a first contacting part 65 as a first contacting raised part that is formed in the vicinity of the free end of the lower side connecting part 64.

Further, the retention receiving part 63 extends in a vertical direction, that is to say the thickness direction, of the first housing 11 and is a part that is engaged and held with the first terminal receptacle outer side cavity 15*b*. In addition, the tail part 62 is connected by bending in relation to the retention receiving part 63, and extends outward in the lateral direction, that is to say the width direction, of the first housing 11, and is connected by soldering or the like to a terminal connection pad that is linked to a conductive trace on the first board 91. Furthermore, the upper side connecting part 67 is connected by bending in relation to the retention receiving part 63 and extends inward in the width direction of the first housing 11.

The curved second contacting part 66 is bent facing downward to the inner direction end of the upper side connecting part 67 and is formed to protrude inward in the width direction of the first housing 11. Further, the lower side connecting part 64 is a part provided with a U shaped side surface shape that is connected to the lower end of the second contacting part 66. The curved first contacting part 65 is bent in a U shape in the vicinity of the free end, that is to say, the upper end of the inner side, of the lower side connecting part 64 and is formed to protrude outward in the width direction of the first housing 11.

The first terminal 61 is inserted into the first terminal receptacle cavity 15 from the mounting surface side (lower side in the drawing), and is anchored to the first housing 11 by being held from both sides by the side walls of the first terminal receptacle outer side cavities 15*b* where the retention receiving part 63 is formed to the side surface of the inner side of the side wall part 14. In this state, in other words the state in which the first terminal 61 is loaded on the first housing 11, the first contacting part 65 and the second contacting part 66 are positioned on both the left and right sides of the recessed groove part 12*a* so as to face each other.

Moreover, the first terminal 61 is a member that is integrally formed by a working process of a metal plate and therefore has a certain amount of flexibility. As is evident from its shape, there is the possibility of flexible deformation in the gap between the mutually facing first contacting part 65 and the second contacting part 66. In other words, when the second terminal 161 of the second connector 101 is inserted between the first contacting part 65 and a second contacting part 66, by so doing, the gap between the first contacting part 65 and a second contacting part 66 flexibly elongates.

In addition, first overhanging end parts 21 are each arranged as first fitting guide parts to both ends in the lengthwise direction of the first housing 11. Each first overhanging end part 21 has an overhanging end recessed part 22 formed as a part of the recessed part 12. The overhanging end recessed part 12 is a nearly rectangular shaped recessed part that is connected to both ends in the lengthwise direction of each recessed groove part 12*a*. Further, the overhanging end part 22 functions as an inserting recessed part when the second overhanging end part 122, to be described hereinafter provided by the second connector 101, is inserted and when the first connector 1 and the second connector 101 are in a fitted state.

In addition, the first overhanging end part 21 is provided with a side wall extending part 21*b* that extends in the long side direction of the first housing 11 from both sides in the long side direction of the side wall part 14, and an end wall part 21*c* that extends in the short side direction of the first housing 11 and is connected to the side wall extending part 21*b* on both ends. With every first overhanging end, the end wall part 21*c* and the side wall extending part 21*b* connected to both ends thereof, form a side wall in the form of a continuous C shape and mark three directions of a nearly rectangular shaped overhanging end recessed part 22.

Furthermore, a first reinforcing bracket 51 is attached as a fitting to the first overhanging end part 21. Specifically, each of the first reinforcing brackets 51 is arranged as a left and right pair within the overhanging end recessed part 22 and is received and held within the first metal fitting recessed part 26 formed at the bottom of the overhanging end recessed part 22. Moreover, the first metal fitting retention recessed part 26 is split into two parts on the left and right (in the width direction of the first housing 11) by the first metal fitting positioned regulating part 27 as a stopper formed in the center with direction of the first housing 11 for the overhanging end recessed part 22. Further, a first metal fitting retention slipped part 26*a* that extends in the thickness direction of the first housing 11 is formed on the side wall extending part 21*b*.

In the present embodiment, the first reinforcing bracket 51 includes a retention receiving part 57 that extends in the thickness direction of the first housing and is a substantially L shaped member punched from a conductive metal plate and is integrally formed by a working process such as bending, a first board connecting part 56 connected by bending to the left and right both ends of the retention receiving part 57 as a main unit that extends in the width direction of the first housing 11, and a first contacting segment 58 connected to the first board connecting part 56 as a flexible contact segment The first reinforcing bracket 51 is fixed to the first housing 11 by the retention receiving part 57 which is inserted from the mounting surface side into the first metal fitting retention slit part 26*a* and held from both sides by the side walls of the first metal fitting retention slit part 26*a*. Further, the first board connecting part 56 functions as a soldering tail part for the first reinforcing bracket 51, and the bottom surface thereof is formed so as to be nearly parallel with the mounting surface not illustrated of the first housing 11 and is anchored by soldering or the like to a first anchoring pad 93 on the first board 91 to be described hereinafter. In addition, the first contacting segment 58 is received into the first metal fitting retention recessed part 26 so as to be nearly parallel with the mounting surface, and the displacement in the direction of the tip thereof, in other words the upward direction of the free end, in other words, the fitting surface direction is regulated by the first metal fitting position regulating part 27. Furthermore, a height difference is formed in a portion where the first board connecting part 56 connects with the first contacting segment 58, and although the first contacting segment 58 is parallel with the first board connecting part 56, it is positioned further to the fitting side than the first board connecting part 56 and is such that the distance from the bottom surface thereof to the first board 91 is larger than the distance from the bottom surface of the first board connecting part 56 to the first board 91.

The second connector 101 includes a second housing 111 as a connector main body that is integrally formed by an insulating material such as a synthetic resin or the like. The second housing 111, as illustrated in the drawing, is substantially a rectangular thick board shape that is substantially a rectangular solid, and is provided with dimensions such as approximately 8.0 mm long, approximately 1.5 mm wide, and approximately 0.8 mm thick, and these dimensions can be suitably changed. Further, a long and narrow recessed groove part 113 that extends in the long side direction of the second housing 111 and a second ridged part 112 that is a long and narrow raised part that extends in the long side direction of the second housing 111 are integrally formed while marking the outside of the recessed groove part 113, on the side in which the first connector 1 of the second housing 111 is inserted, in other words, the fitting surface side (upper side in the drawing). The second ridged part 112 is formed along both sides of the second housing 111 and along both sides of the recessed groove part 113. In addition, each of the second ridged parts 112 have a second terminal 161 arranged as terminals.

As illustrated in the drawing, the recessed groove part 113 is stopped by the bottom part on the side where it is mounted on the second board 191, in other words, the mounting surface (lower surface in the drawing). Moreover, although there are two second ridged parts 112 in the example illustrated in the drawing, it can also be singular and there can be any number thereof. In addition, the recessed groove part 113 is provided with a dimension of, for example, 0.7 mm in width, and this dimension can be suitably changed.

The second terminal 161 is a member integrally formed by a working process such as stamping or bending a conductive metal plate, and is provided with a main body part not illustrated in the drawing, a tail part 162 that is connected to the bottom end of the main body part, a first contacting part 165 that is connected to the top end of the main body part, a connecting part 164 that is connected to the top end of the first contacting part 165, and a second contacting part 166 that is connected to the outer end of the connecting part 164. Further, a first contacting recessed part 165*a* that engages with the first contacting part 65 of the first terminal 61 is formed on the surface of the first contacting part 165, and a second contacting recessed part 166*a* that engages with the second contacting part 66 of the first terminal 61 is respectively formed on the surface of the second contacting part 166.

Figure 3:
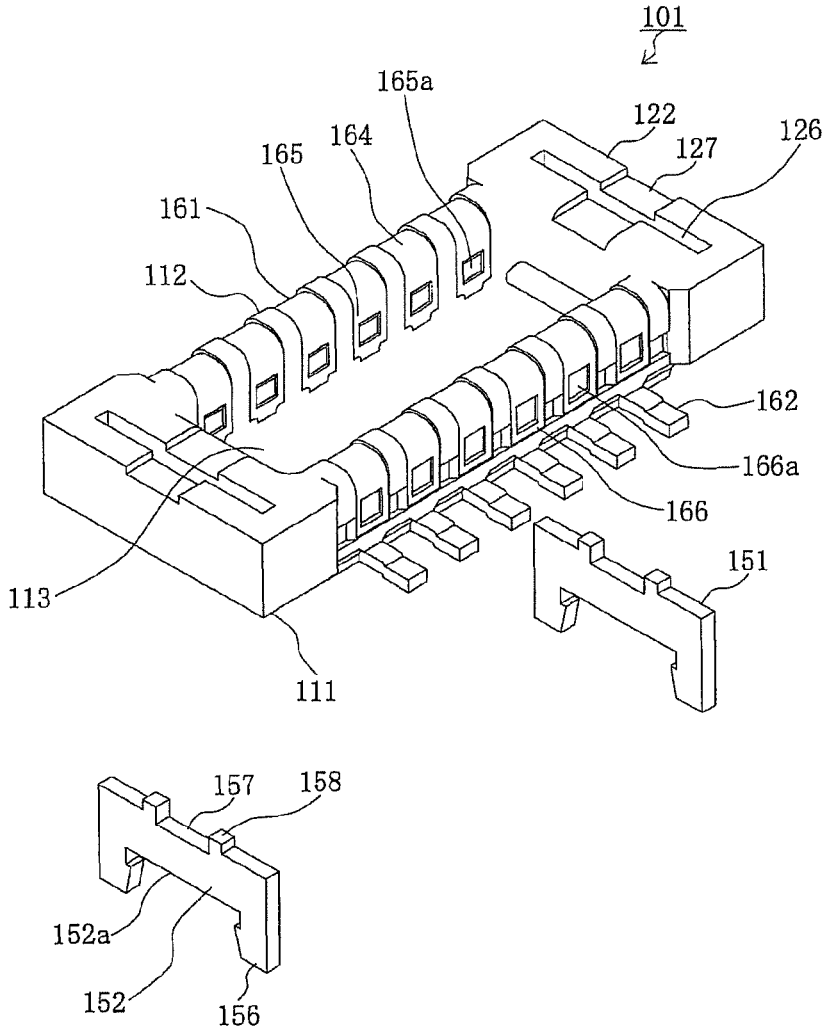
FIG. 3 is an exploded view as seen from the fitting surface side of a second connector according to the first embodiment of the Present Disclosure.

Further, the main body part is a part that is held by surrounding the periphery of the second housing 111, and is a part not illustrated in FIG. 3. Additionally, the tail part 162 is connected to the bottom end that extends in the lateral direction of the main body part, that is to say the width direction of the second housing 111, and extents outward of the second housing 111, and is connected by soldering or the like to a terminal connection pad that is linked to a conductive trace on the second board 191.

Further, the first contacting part 165 is connected to the main body part and is a part in a flat plate shape that extends in the vertical direction, that is to say the thickness direction of the second housing 111. Furthermore, the connecting part 164 is connected by bending in relation to the first contacting part 165 and extends outward in the width direction of the second housing 111. In addition, the second contacting part 166 is connected by bending downward to the outer end of the connecting part 164 and is a part that extends downward.

The second terminals 161 are integrated with the second housing 111 by over molding. In other words, the second housing 111 is formed by filling resin in the cavity of a mold in which the second terminals 161 are prepared inside in advance. By so doing, the second terminals 161 can be integrally attached to the second housing 111 in a state in which the main body part is embedded within the second housing 111 and the surfaces of the first contacting part 165, the connecting part 164, and the second contacting part 166 are exposed to each side surface of the second ridged part 112 as well as to the fitting surface. In this case, the second terminals 161 are arranged, for example, in 6 pieces each on the left and right at a pitch of approximately 0.4 mm. Moreover, the pitch and number of second terminals 161 can be suitably changed.

In addition, second overhanging end parts 122 are each arranged as second fitting guide parts to both ends in the long side direction of the second housing 111. The second overhanging end part 122 is a thick member that extends in the width direction of the second housing 111 where both ends are connected to both ends in the long side direction of each second ridged part 112, and the upper surface thereof provides a substantially rectangular shape. Further, the second overhanging end part 122 functions as an inserting ridged part inserted into the overhanging end recessed part 22 of the first overhanging end part 21 provided by the first connector 1 when the first connector 1 and the second connector 101 are in a fitted state.

In addition, a regulating part receiving recessed groove part 127 is formed on the surface, i.e., the upper surface, of the fitting surface side of the second overhanging end part 122. The regulating part receiving recessed groove part 127 is a concave insertion part in the shape of a groove that extends in the long side direction of the second housing 111, and the first metal fitting position regulating part 27 enters when the second overhanging end part 122 is inserted into the overhanging end recessed part 22 of the first connector 1.

Furthermore, a second reinforcing bracket 151 is attached as a reinforcing metal fitting to the second overhanging end part 122. The second reinforcing bracket 151 is received and held within the second metal fitting retention recessed part 126 formed on the second overhanging end part 122. Moreover, the opening of the slit shape of the second metal fitting retention recessed part 126 on the upper surface of the second overhanging end part 122 extends in the long side direction of the second housing 111 and transverses the regulating part receiving recessed groove part 127.

The second reinforcing bracket 151 in the present embodiment is a member integrally formed by a working process such as punching a conductive metal plate and is provided with a second main body part 152 in the shape of a long and narrow band that extends in the width direction of the second housing 111 as a complete body, a second board connecting part 156 that is connected by bending to both the left and right ends of the second main body part 152 and extends in the direction of the mounting surface, and a left and right pair of second fit completion detecting parts 158 as rigid contact segments that extend so as to further project from the upper end of the second main body part 152.

Further, the second reinforcing bracket 151 is fixed to the second housing 111 by being inserted from the fitting surface side into the second metal fitting retention recessed part 126*a* and is held from both sides by the side walls of the second metal fitting retention recessed part 126*a*. At this time, the position of the second reinforcing bracket 151 is determined by the contact between the reinforcing bracket side reference plane 152*a* which is the edge surface of the mounting surface side of the second main body part 152, and the housing side reference plane 126*a* to be described hereinafter arranged within the second metal fitting retention recessed part 126. In the position determined state, the second fit completion detecting part 158 protrudes from the upper surface of the second overhanging end part 122. Note, the regulating part receiving recessed groove part 157, which is the part between the left and right second fit completion detecting parts 158 on the edge surface of the fitting surface side of the second main body part 152, does not protrude more than the regulating part receiving recessed groove part 127.

The upper end surface of the second fit completion detecting part 158 is the part that conducts by connecting with the upper surface of the first contacting segment 58 in a state in which the fit between the first connector 1 and the second connector 101 is completed. Accordingly, the second fit completion detecting part 158 is formed in a position that corresponds to a range in which the vicinity of the free end of the first contacting segment 58 is positioned in the first connector 1 as the other connector. Further, the second board connecting part 156 functions as a soldering tail part for the second reinforcing bracket 151, and the bottom surface thereof is formed so as to be nearly parallel with the mounting surface not illustrated of the second housing 111 and is anchored by soldering or the like to a second anchoring pad 193 to be described hereinafter on the second board 191.

Figure 4:
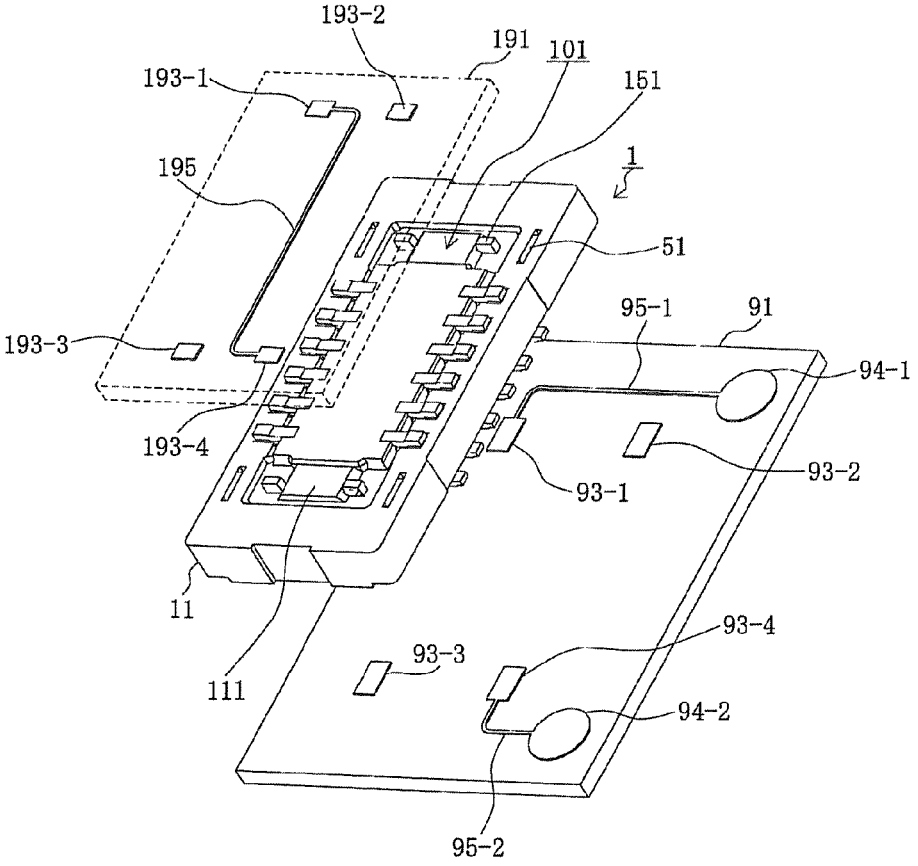
FIG. 4 is a perspective view illustrating the relationship between the board and the board-to-board connector in the first embodiment of the Present Disclosure.

In the present embodiment, as illustrated in FIG. 4, first anchoring pads 93-1 to 93-4 are provided as anchoring pads together with detecting pads 94-1 and 94-2 are arranged on the first board 91. Moreover, when collectively describing the first anchoring pads 93-1 to 93-4 together with the detecting pads 94-1 and 94-2, each will be described respectively as the first anchoring pads 93 and detecting pads 94. Further, in FIG. 4, for convenience in the description, the illustration for the terminal connection pad to which the tail part 62 of the first terminal 61 is connected is omitted.

The first anchoring pads 93 are pads to which the first board connecting parts 56 of the first reinforcing brackets 51 are affixed and are made of a conductive metal or the like and are provided in a position that corresponds to the first board connecting parts 56 for each first reinforcing bracket 51. Further, the detecting pads 94 are pads to which a pair of terminals from a testing device such as a tester are connected and are made of a conductive metal or the like and are provided in the vicinity of the position where the first connector 1 is mounted. In addition, the detecting pad 94-1 has conductivity with the first anchoring pad 93-1 via the first detecting conductive trace 95-1, and the detecting pad 94-2 has conductivity with the first anchoring pad 93-4 via the first detecting conductive trace 95-2. Note, when collectively describing the first detecting conductive traces 95-1 and 95-2, a description will be provided as the first detecting conductive trace 95. In other words, the detecting pads 94 have conductivity with the pair of first anchoring pads 93 positioned on a diagonal line via the first detecting conductive traces 95.

Further, as illustrated in FIG. 4, second anchoring pads 193-1 to 193-4 are arranged as anchoring pads on the second board 191. Note, when collectively describing the second anchoring pads 193-1 to 193-4, a description will be provided as the second anchoring pads 193. Further, in FIG. 4, the second board 191 itself is depicted virtually while the second anchoring pads 193 are depicted by actual lines. This is because the second anchoring pads 193 are arranged on the surface of the underside in a drawing of the second board 191 and therefore would normally not be able to be seen visually as they are hidden behind the second board 191. In addition, in FIG. 4, for convenience in the description, the illustration for the terminal connection pad to which the tail part 162 of the second terminal 161 is connected is omitted.

The second anchoring pads 193 are pads to which the second board connecting parts 156 of the second reinforcing brackets 151 are fixed and are made of a conductive metal and are arranged in positions that correspond to the second board connecting parts 156 of each second reinforcing bracket 151. Further, the second anchoring pad 193-1 and the second anchoring pad 193-4 have mutual conductivity in the second detecting conductive trace 195. In other words, each of the pairs of second anchoring pads 193 positioned on a diagonal line have mutual conductivity via the second detecting conductive trace 195. The mutually conductive second anchoring pads 193 are in positions that substantially oppose the first anchoring pad 93 that is conductive with the detecting pad 94 on the first board 91.

In addition, when fitting the first connector 1 with the second connector 101, the first connector 1 is surface mounted in advance on the first board 91 by the tail part 62 of the first terminals 61 that is connected by soldering or the like to the terminal connection pad on the first board 91, and the first board connecting part 56 of the first reinforcing bracket 51 is connected by soldering or the like to the first anchoring pad 93 of the first board 91. Further, the second connector 101 is surface mounted in advance on the second board 191 by the tail part 162 of the second terminals 161 that is connected by soldering or the like to the terminal connection pad that on the second board 191, and the second board connecting part 156 of the second reinforcing bracket 151 is connected by soldering or the like to the second anchoring pad 193 of the second board 191. Moreover, the first board 91 and second board 191 are omitted from the drawing for convenience in the explanation for FIG. 5 to FIG. 7.

The operator positions the first connector 1 and the second connector 101 to make a state in which the fitting surface of the first connector 1 faces the fitting surface of the second connector 101 then moves the first connector 1 and/or the second connector 101 in a direction to approach the side of the other, that is to say the fitting direction. By so doing, the left and right second ridged parts 112 of the second connector 101 are inserted into the left and right recessed groove parts 12*a* of the first connector 1. Further, the second terminals 161 of the second connector of 101 are inserted between the first contacting parts 65 and the second contacting parts 66 of each of the first terminals 61, and the first contacting parts 65 of the first terminals 61 contact with the surfaces of the first contacting parts 165 of the second terminals 161 and the second contacting parts 66 of the first terminals 61 contact with the surfaces of the second contacting parts 166 of the second terminals 161. By so doing, the gap between the first contacting part 65 and the second contacting part 66 in the first terminals 61 is widened by the second terminals 161 to flexibly elongate.

Figure 5:
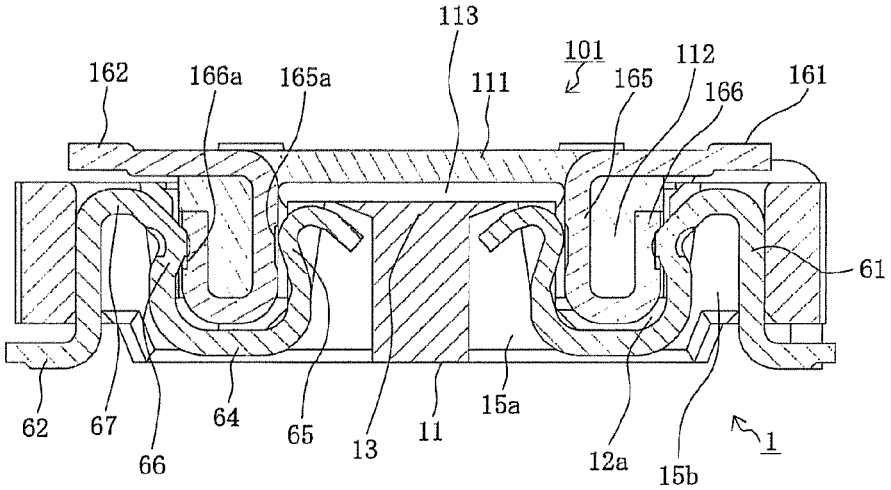
FIG. 5 is a cross sectional view illustrating the relationship between the first terminal and the second terminal when the fitting of the connector is in a completed state in the first embodiment of the Present Disclosure, and is a cross sectional view along arrow A-A in FIG. 2.

Next, when the operator further moves the second connector 101 in a relative fitting direction in relation to the first connector 1, a complete fit is made when the fit between the first connector 1 and the second connector 101 is complete, and as illustrated in FIG. 5, the first contacting part 65 of the first terminals 61 engage with the first contacting recessed part 165*a* of the second terminals 161, and the second contacting part 66 of the first terminals 61 is in an engaged state with the second contacting recessed part 166*a* of the second terminals 161.

As a result, there is conductivity with the conductive trace connected to the terminal connection pad on the first board 91 where the tail part 62 of the first terminal 61 is connected, and with the conductive trace connected to the terminal connection pad 192 on the second board 191 where the tail part 162 of the second terminal 161 is connected.

Figure 6:
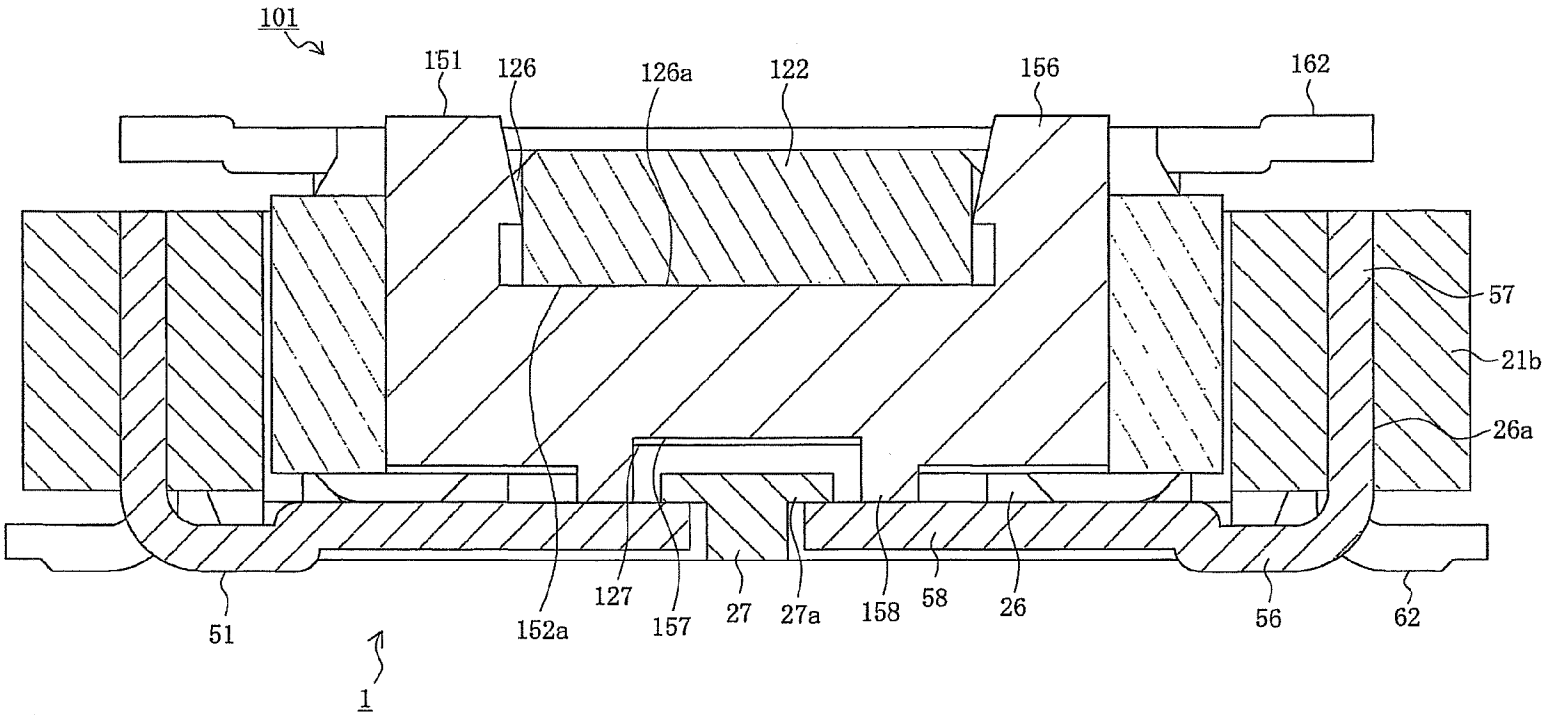
FIG. 6 is a cross sectional view illustrating the relationship between the first reinforcing bracket and the second reinforcing bracket when the fitting of the board-to-board connector is in a completed state in the first embodiment of the Present Disclosure, and is a cross sectional view along arrow B-B in FIG. 2.

In addition, when the fit between the first connector 1 and the second connector 101 is complete, in other words when making a complete fit, as illustrated in FIG. 6, the upper surface of the first contacting segment 58 of the first connector 1 contacts for conductivity with the upper end of the second fit completion detecting part 158 (lower end in FIG. 6) of the second connector 101. As a result, the detection circuit for detecting the fit completion between the first connector 1 and the second connector 101 closes, and the complete fit between the first connector 1 in the second connector 101 is electrically detected. In other words, the first contacting segment 58 and the second fit completion detecting part 158 function as a switching member for a complete fit detection switch.

Moreover, the explanation of the detection circuit according to the example illustrated in FIG. 4 will be given in the following order: the detecting pad 94-1, the first detecting conductive trace 95-1, the first anchoring pad 93-1, the left upper first reinforcing bracket 51, the upper second reinforcing bracket 151, the second anchoring pad 193-1, the second detecting conductive trace 195, the second anchoring pad 193-4, the lower second reinforcing bracket 151, the right lower first reinforcing bracket 51, the first anchoring pad 93-4, the first detecting conductive trace 95-2, and the detecting pad 94-2. Therefore, if, for example, a pair of terminals for a testing device that has the ability to detect a conductive state for a circuit such as a tester is connected to the detecting pad 94-1 and the detecting pad 94-2, the detection circuit can be closed to be able to detect a conductive state, and in this manner, a complete fit between the first connector 1 and the second connector 101 can be electrically detected.

However, as illustrated in FIG. 6, the first metal fitting position regulating part 27 is a member that provides a cross-sectional shape substantially in the shape of a T and has an eave part 27*a* that extends in both sides of the width direction of the first housing 11. Further, displacement for the tip end of the first contacting segment 58 in the upward direction, in other words, the fitting surface direction, is regulated by the eave part 27*a* of the first metal fitting position regulating part 27. In other words, displacement of the free end of the first contacting segment 58 is impossible to the fitting surface direction further than the eave part 27*a*. Therefore, after beginning fitting of the first connector 1 with the second connector 101 until the positional relationship between the first connector 1 and the second connector 101 achieves the state illustrated in FIG. 6, that is to say until achieving a complete fit, there is no contact between the first contacting segment 58 and the second fit completion detecting part 158. In other words, a complete fit can be accurately detected between the first connector 1 and the second connector 101 because the first contacting segment 58 contacts the second fit completion detecting part 158 to prevent a conductive state with the detection circuit prior to achieving a complete fit.

Furthermore, the shape of the first reinforcing bracket 51 in a free state is typically such that the free end of the first contacting segment 58 is positioned further upward than the state illustrated in FIG. 6. In addition, when the first reinforcing bracket 51 is attached to the first housing 11, the free end of the first contacting segment 58 is in a state in which a preload is applied downward by the eave part 27*a* of the first metal fitting position regulating part. Therefore, because the free end of the first contacting segment 58 presses on the lower surface of the eave part 27*a* to function as a spring for the first connecting segment 58, in this manner, the position of the first contacting segment 58 is fixed prior to the complete fit. Therefore, a complete fit between the first and the second connectors 1, 101 can be accurately detected.

Further, the reinforcing bracket side reference plane 152*a* of the second main body part 152 contacts the housing side reference plane 126*a* within the second metal fitting retention recessed part 126. Typically, the reinforcing bracket side reference plane 152*a* and the housing side reference plane 126*a* recreated to a higher precision then the other members. Therefore, the position and disposition in relation to the second housing 111 can be accurately held by the reinforcing bracket side reference plane 152*a* contacting with the housing side reference plane 126*a*. Therefore, the position in relation to the second housing 111 of the left and right second fit completion detecting parts 158, that is to say the position on the second connector 101, is also accurate. Therefore, a complete fit between the first connector 1 and the second connector 101 can be accurately detected.

However, because the area of the first board 91 and the second board 191 with wide areas normally have a significantly wider area compared to the fit surface of the first connector 1 and the second connector 101, the operator will undertake fitting labor by trial and error without being able to see the fit surface of the first connector 1 and the fit surface of the second connector 101. Therefore, because the operator is unable to determine whether the fit has been completed between the first connector 1 and the second connector 101 without the ability to know the positional relationship between the fit surface of the first connector 1 and the fit surface of the second connector 101, the operator may further move the first connector 1 and/or the second connector 101 in the fit direction even after the fit between the first connector 1 and the second connector 101 has been completed.

Figure 7:
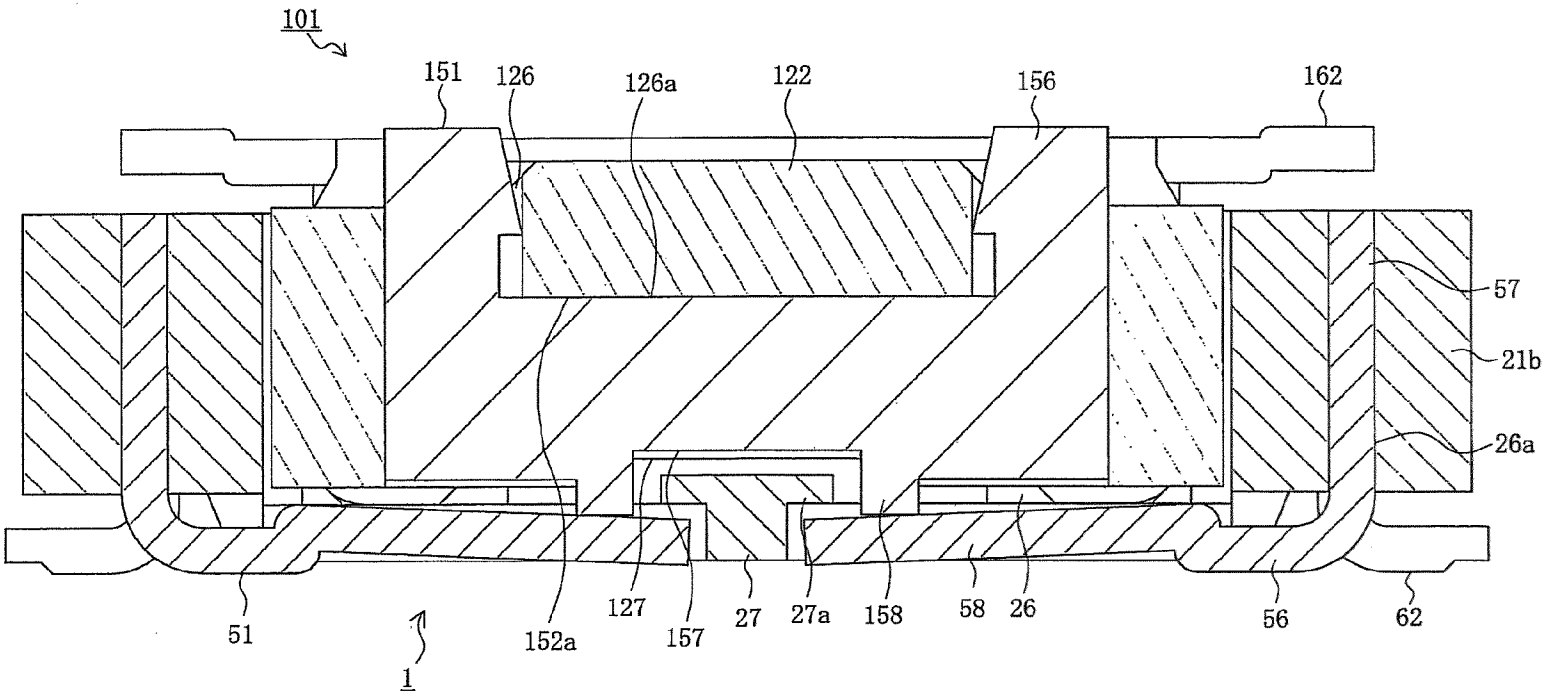
FIG. 7 is a cross sectional view illustrating the relationship between the first reinforcing bracket and the second reinforcing bracket when the fitting of the connector is in a displaced state further in the fit direction after completion in the first embodiment of the Present Disclosure.

In this case, the first contacting segment 58, as illustrated in FIG. 7, absorbs the further displacement of the second connector 101 in relation to the first connector 1, more specifically, the further displacement of the second fit completion detecting part 158, by the flexible deformation in the fit direction. Therefore, the contact reliability is improved between the first contacting segment 58 and the second fit completion detecting part 158 because the contact between the first contacting segment 58 and the second fit completion detecting part 158 is maintained even when the second connector 101 is displaced further in the fit direction from the position of a complete fit in relation to the first connector 1. As a result, the reliability of the detection circuit is improved and the detection precision for a complete fit between the first connector 1 and the second connector 101 is improved.

In this manner, because in the present embodiment the first connector 1 and the second connector 101 are configured so as to electrically detect the complete fit, the complete fit between the first connector 1 in the second connector 101 can be accurately confirmed without the operator seeing, feeling with his hand, hearing a click sound, or the like, or in other words relying on the five senses of the operator. Accordingly, a board-to-board connector with high reliability can be provided that can securely prevent the occurrence of incomplete fitting in a fitting process even when fit completion is difficult to confirm by an operator seeing, feeling with his hand, hearing a click sound, or the like, when the first connector 1 and the second connector 101 have a small size and low height.

Furthermore, in the present embodiment, the first reinforcing bracket 51 and the second reinforcing bracket 151 will be used as a part of the detection circuit for detecting a complete fit in order to improve the mounting strength onto the first board 91 and the second board 191 of the first connector 1 and the second connector 101. Therefore, because it is not necessary to attach a member for detecting the complete fit to the first connector 1 and the second connector 101, increasing the size and the number of components in the first connector 1 and the second connector 101 can be prevented. In addition, because the first terminals 61 and the second terminals 161 are not used in the detection circuit, the number of terminals or the number of poles are essentially not reduced.

Additionally, in the present embodiment, further displacement from a complete fit of the second connector 101 with the first connector 1 is absorbed by the first contacting segment 58 flexibly deforming in the fit direction, thereby improving the reliability of the detection circuit and improving the detection precision of a complete fit between the first connector 1 and the second connector 101.

Figure 8:
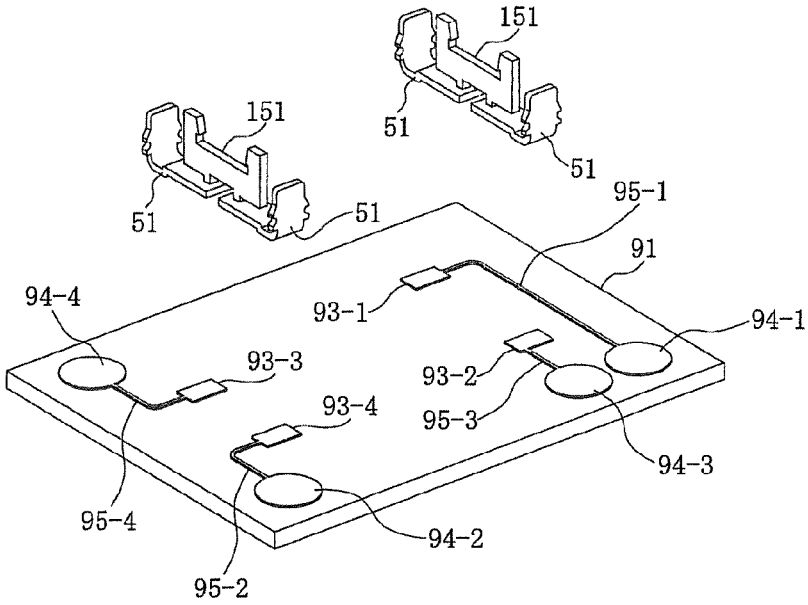
FIG. 8 is a perspective view illustrating the connection relationship between the detecting pad and the first anchoring pad in the second embodiment of the Present Disclosure.

In the present embodiment, as illustrated in FIG. 8, first anchoring pads 93-1 to 93-4 are provided as anchoring pads together with detecting pads 94-1 to 94-4 and first detecting conductive traces 95-1 to 95-4 are arranged on the first board 91. In other words, compared to the first embodiment, detecting pads 94-3 and 94-4, together with first detecting conductive trace 95-3 for conductivity between the first anchoring pad 93-2 and the detecting pad 94-3, and first detecting conductive trace 95-4 for conductivity between the first anchoring pad 93-3 and the detecting pad 94-4, have been added. Further, the second detecting conductive trace 195 on the second board 191 has been removed.

Moreover, in the drawing, the illustration of the second board 191 is removed while the illustrations for members other than the first reinforcing bracket 51 and the second reinforcing bracket 151 are also removed for the first connector 1 and the second connector 101.

In the present embodiment, there are two detection circuits for detecting the fit completion between the first connector 1 and the second connector 101. The explanation of the first detection circuit according to the example illustrated in FIG. 8 will be according to the following order: the detecting pad 94-1, the first detecting conductive trace 95-1, the first anchoring pad 93-1, the back right first reinforcing bracket 51, the right side second reinforcing bracket the 151, the right front first reinforcing bracket 51, the first anchoring pad 93-2, the first detecting conductive trace 95-3, and the detecting pad 94-3. Further, the explanation of the second detection circuit according to the example illustrated in FIG. 8 will be according to the following order: the detecting pad 94-2, the first detecting conductive trace 95-2, the first anchoring pad 93-4, the left front first reinforcing bracket 51, the left side second reinforcing bracket the 151, the back left first reinforcing bracket 51, the first anchoring pad 93-3, the first detecting conductive trace 95-4, and the detecting pad 94-4.

Therefore, if a pair of terminals for a testing device is connected to the detecting pad 94-1 and the detecting pad 94-3 and a pair of terminals of another testing device is connected to the detecting pad 94-2 and the detecting pad 94-4, the detection circuit can be closed to be able to detect a conductive state, and in this manner, a complete fit between the first connector 1 and the second connector 101 can be electrically detected.

Further, other points of configuration and operation with the first connector 1 in the second connector 101 together with the first board 91 and the second board 191 are similar to the first embodiment, and therefore descriptions thereof are omitted.

In this manner, because in the present embodiment respective detection circuits are formed that correspond to both ends of the long side direction of the first connector 1 and the second connector 101, a complete fit between the first connector 1 and the second connector 101 can be more security detected.

In addition, because there is no need to form the second detecting conductive trace 195 on the second board 191, cost can be reduced, and furthermore, a circuit other than the second detecting conductive trace 195 not illustrated such as a signal trace or a power trace or the like can be arranged on the second board 191.

Figure 9:
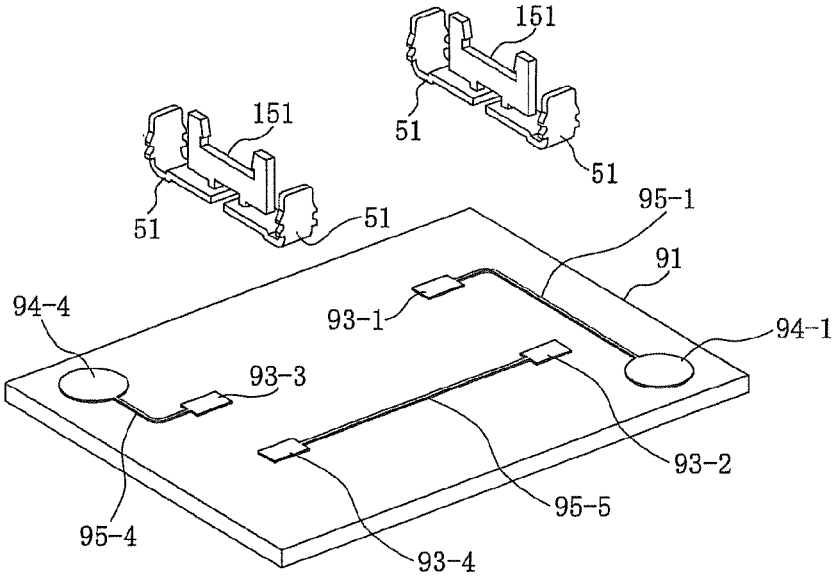
FIG. 9 is a perspective view illustrating the connection relationship between the detecting pad and the first anchoring pad in the third embodiment of the Present Disclosure.

In the present embodiment, as illustrated in FIG. 9, first anchoring pads 93-1 to 93-4 are provided as anchoring pads, the detecting pads 94-1 and 94-4 and the first detecting conductive traces 95-1, 95-4, and 95-5 are arranged on the first board 91. In other words, compared to the second embodiment, the first detecting conductive trace 95-5 for conductivity between the first anchoring pad 93-2 and the second anchoring pad 93-4 is added while detecting pads 94-2 and 94-3, together with first detecting conductive trace 95-2 for conductivity between the first anchoring pad 93-4 and the detecting pad 94-2, and first detecting conductive trace 95-3 for conductivity between the first anchoring pad 93-2 and the detecting pad 94-3, have been removed.

Moreover, in the drawing, the illustration of the second board 191 is removed while the illustrations for members other than the first reinforcing bracket 51 and the second reinforcing bracket 151 are also removed for the first connector 1 and the second connector 101.

In the present embodiment, there is one detection circuit for detecting the fit completion between the first connector 1 and the second connector 101. Further, the explanation of the detection circuit according to the example illustrated in FIG. 9 will be according to the following order: the detecting pad 94-1, the first detecting conductive trace 95-1, the first anchoring pad 93-1, the back right the first reinforcing bracket 51, the right side second reinforcing bracket 151, the right front first reinforcing bracket 51, the first anchoring pad 93-2, the first detecting conductive trace 95-5, the first anchoring pad 93-4, the left front first reinforcing bracket 51, the left side second reinforcing bracket the 151, the back left first reinforcing bracket 51, the first anchoring pad 93-3, the first detecting conductive trace 95-4, and the detecting pad 94-4.

Thus, if a pair of terminals for a testing device is connected to the detecting pad 94-1 and the detecting pad 94-4, the detection circuit can be closed to be able to detect a conductive state, and in this manner, a complete fit between the first connector 1 and the second connector 101 can be electrically detected. Further, other points of configuration and operation with the first connector 1 in the second connector 101 together with the first board 91 and the second board 191 are similar to the first and second embodiments, and thus descriptions thereof are omitted.

In this manner, because in the present embodiment a single detection circuit is provided that corresponds to both ends of the long side direction of the first connector 1 and the second connector 101, a complete fit between the first connector 1 and the second connector 101 can be more security detected. In addition, because there is no need to form the second detecting conductive trace 195 on the second board 191, cost can be reduced.

Figure 10:
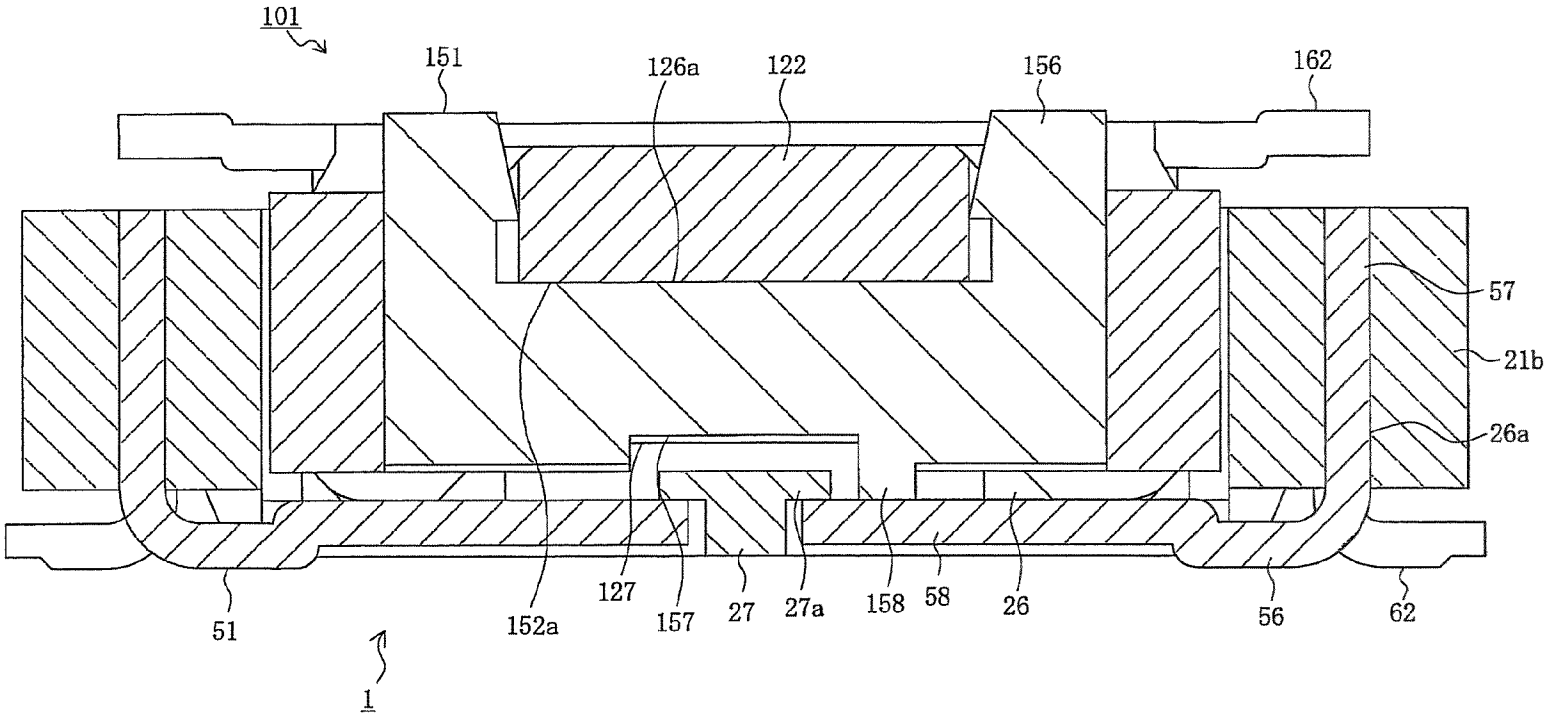
FIG. 10 is a cross sectional view illustrating the relationship between the first reinforcing bracket and the second reinforcing bracket when the fitting of the board-to-board connector is in a completed state in the fourth embodiment of the Present Disclosure.

In the present embodiment, as illustrated in FIG. 10, the second reinforcing bracket 151 provides a second fit completion detecting part 158 on only either the left or right side. Further, when the fit between the first connector 1 and the second connector 101 is complete, in other words when making a complete fit, as illustrated in FIG. 10, the upper surface of the first contacting segment 58 on one side of the first connector 1 contacts for conductivity with the upper end of the second fit completion detecting part 158 (lower end in FIG. 10) of the second connector 101. As a result, the detection circuit for detecting the fit completion between the first connector 1 and the second connector 101 closes, and the complete fit between the first connector 1 in the second connector 101 is electrically detected.

Figure 11:
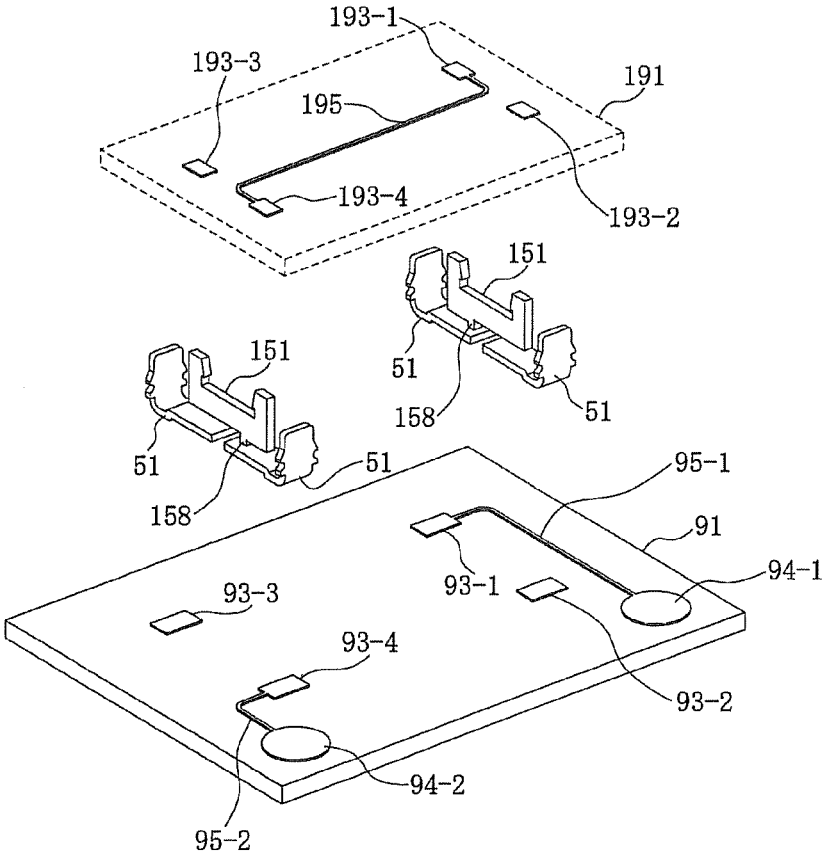
FIG. 11 is a perspective view illustrating the relationship between the board and the board-to-board connector in the fourth embodiment of the Present Disclosure.

In the present embodiment, a pair of second reinforcing bracket's 151, as illustrated in FIG. 11, is provided so that the position of the second fit completion detecting parts 158 differs to the left and right. Moreover, the illustrations for members other than the first reinforcing bracket 51 and the second reinforcing bracket 151 are removed for the first connector 1 and the second connector 101. Further, in FIG. 11, similar to that in FIG. 4, the second board 191 itself is depicted virtually while the second anchoring pads 193 and the second detecting conductive trace 195 are depicted by actual lines.

In addition, the positions in the present embodiment for the first anchoring pad 93, detecting pad 94, first detecting conductive trace 95, second anchoring pad 193, and the second detecting conductive trace 195 are similar to the example illustrated in FIG. 4. The detection circuit for detecting fit completion between the first connector 1 and the second connector 101 in the present embodiment is in the order of the detecting pad 94-1, the first detecting conductive trace 95-1, the first anchoring pad 93-1, the back right first reinforcing bracket 51, the right side second reinforcing bracket 151, the second anchoring pad 193-1, the second detecting conductive trace 195, the second anchoring pad 193-4, the left side second reinforcing bracket 151, the front left first reinforcing bracket 51, the first anchoring pad 93-4, the first detecting conductive trace 95-2, and the detecting pad 94-2.

Further, other points of configuration and operation with the first connector 1 in the second connector 101 together with the first board 91 and the second board 191 are similar to the first embodiment, and therefore descriptions thereof are omitted.

Figure 12:
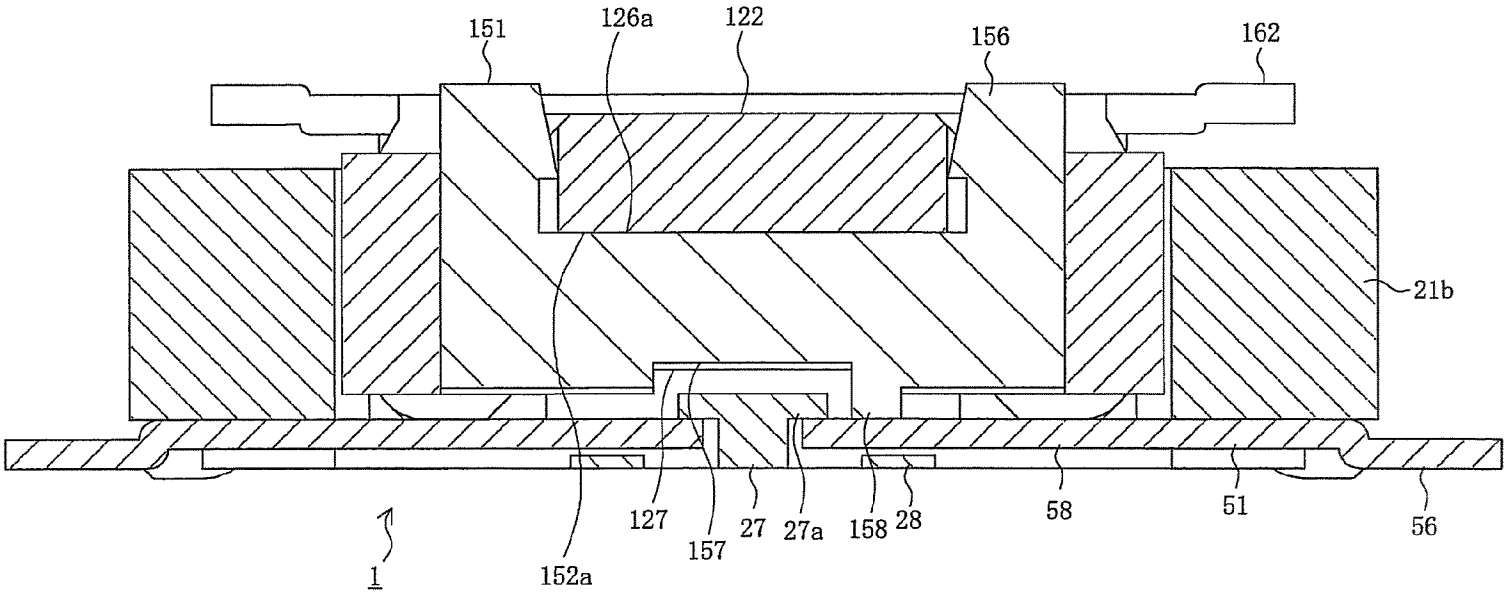
FIG. 12 is a cross sectional view illustrating the relationship between the first reinforcing bracket and the second reinforcing bracket when the fitting of the board-to-board connector is in a completed state in the fifth embodiment of the Present Disclosure.
Figure 13:
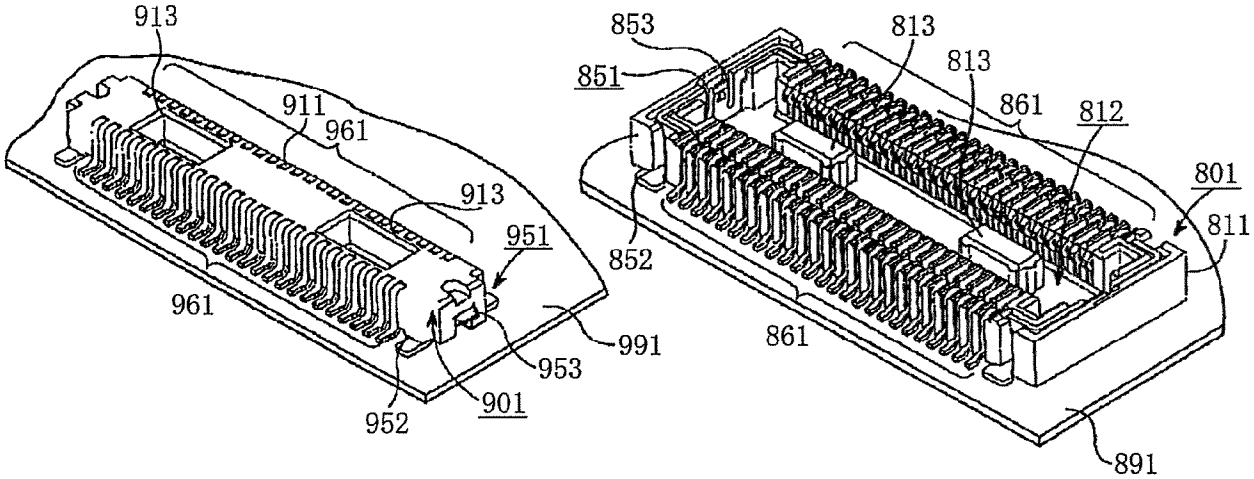
Prior art FIG. 13
FIG. 13 is a perspective view of the pre-fit state of a conventional connector.

In the present embodiment, as illustrated in FIG. 12, the first reinforcing bracket 51 is not provided with the retention receiving part 57, and the connecting portion with the first board connecting part 56 for the first contacting segment 58 is attached to the lower end of the side wall extending part 21*b* of the first housing 11. In this case, the first reinforcing bracket 51 is configured so as to be inserted and held in the insertion recessed part formed on the lower side of the side wall extending part 21*b* from the side.

Further, the second metal fitting positioned regulating part 28 is provided below the first contacting segment 58, and displacement is regulated downward, in other words in the mounting surface direction, of the free end of the first contacting segment 58. In other words, displacement of the free end of the first contacting segment 58 is impossible to the mounting surface direction further than the second metal fitting positioned regulating part 28.

Therefore, the first contacting segment 58 does not contact the upper surface of the first board 91 even when the second connector 101 is displaced further in the fit direction from the position of a complete fit in relation to the first connector 1 and thus the upper surface of the first board 91 is not damaged. In addition, a short cannot occur between the first contacting segment 58 and the circuit in front of it even if circuits such as a signal trace or a power trace are formed on the upper surface of the first board 91.

Further, other points of configuration and operation with the first connector 1 in the second connector 101 together with the first board 91 and the second board 191 are similar to the fourth embodiment, and therefore descriptions thereof are omitted. In this manner, because the retention receiving part 57 is omitted in the present embodiment, the composition of the first reinforcing bracket 51 can be simplified.

While a preferred embodiment of the Present Disclosure is shown and described, it is envisioned that those skilled in the art may devise various modifications without departing from the spirit and scope of the foregoing Description and the appended Claims.

What is claimed is:

1. A board-to-board connector, the board-to-board connector comprising:

a first connector, the first connector including a first terminal and a first housing, the first housing including a first fitting guide part, the first fitting guide part being formed on both ends in the long side direction;

a second connector, the second connector including a second terminal, which contacts the first terminal, and a second housing, the second housing including a second fitting guide part, the second fitting guide part fits with the first fitting guide part; and a switch, the switch configured to close a detection circuit that electrically detects a complete fit of the first connector and the second connector, wherein the first connector further includes a first reinforcing bracket provided on the first fitting guide part, wherein the second connector further includes a second reinforcing bracket provided on the second fitting guide part, wherein the switch includes a plurality of switching members, each switching member having the ability to mutually contact, one side of each switching member being the first reinforcing bracket and the other side being the second reinforcing bracket, wherein the first reinforcing bracket further includes a flexible contact segment substantially parallel to a mounting face of the first housing, wherein the second reinforcing bracket further includes a rigid contact segment, and wherein the flexible contact segment flexibly displaces while maintaining contact with the rigid contact segment when the first connector and the second connector relatively move in the fit direction to a position of a complete fit.

2. The board-to-board connector of claim 1, wherein the first reinforcing bracket and the second reinforcing bracket are electrically connected to an anchoring pad on the board.

3. The board-to-board connector of claim 2, wherein a detecting pad is formed on the board, the detecting pad being disposed on both ends of the detection circuit.

4. The board-to-board connector of claim 1, wherein the first reinforcing bracket and the second reinforcing bracket are electrically connected to an anchoring pad on the board.

5. The board-to-board connector of claim 4, wherein a detecting pad is formed on the board, the detecting pad being disposed on both ends of the detection circuit.

6. The board-to-board connector of claim 1, wherein the displacement by the flexible contact segment in the fit surface direction of the first housing is regulated by the stopper.

7. The board-to-board connector of claim 6, wherein the first reinforcing bracket and the second reinforcing bracket are electrically connected to an anchoring pad on the board.

8. The board-to-board connector of claim 7, wherein a detecting pad is formed on the board, the detecting pad being disposed on both ends of the detection circuit.

9. The board-to-board connector of claim 1, wherein the first housing further includes a stopper.

* * * * *